US007658588B1

(12) United States Patent
Schopf et al.

(10) Patent No.: US 7,658,588 B1
(45) Date of Patent: Feb. 9, 2010

(54) OPTIMIZED BLADE TIP CLEARANCE PROCESS FOR A RUB TOLERANT DESIGN

(75) Inventors: Cheryl A. Schopf, Jupiter, FL (US); Jack W. Wilson, Jr., Palm Beach Gardens, FL (US)

(73) Assignee: Florida Turbine Technologies, Inc., Jupiter, FL (US)

( * ) Notice: Subject to any disclaimer, the term of this patent is extended or adjusted under 35 U.S.C. 154(b) by 630 days.

(21) Appl. No.: 11/698,382

(22) Filed: Jan. 26, 2007

Related U.S. Application Data

(60) Provisional application No. 60/763,090, filed on Jan. 27, 2006.

(51) Int. Cl.
*F01D 11/08* (2006.01)

(52) U.S. Cl. ..... 415/1; 415/173.1

(58) Field of Classification Search ..... 415/1, 415/173.1, 173.6

See application file for complete search history.

(56) References Cited

U.S. PATENT DOCUMENTS 4,262,538 A 4/1981 Otawara
4,485,678 A 12/1984 Fanuele
4,502,046 A 2/1985 Wonn et al.
4,518,917 A 5/1985 Oates et al.
4,563,675 A 1/1986 Miller et al.
6,486,487 B2 * 11/2002 Johnson et al. ..... 250/559.26
6,868,363 B2 * 3/2005 Baran et al. ..... 702/158
6,935,187 B1 * 8/2005 Gorman et al. ..... 73/811
7,455,495 B2 * 11/2008 Leogrande et al. ..... 415/1

* cited by examiner

*Primary Examiner*—Ninh H Nguyen
(74) *Attorney, Agent, or Firm*—John Ryznic

(57) ABSTRACT

A process for optimizing a blade tip clearance for a rub tolerate design in a gas turbine engine that includes evaluating a selection of candidate materials for galling and heat generation, selecting a subset of the candidate materials and analyze engine transient tip clearance for the subset materials, verifying the optimum material cooling and heat shielding for tip clearance and structures, and analyze and select an engine break-in procedure for the optimum tip clearance between turbine and compressor. If one of the subset materials results in a poor performance, than another material from the candidate materials is selected and reanalyzed until the best materials have been found. When the best materials are found, then a finite element method of analysis is performed from the blade and the static parts that form the tip clearance is performed to evaluate the materials for damage. If required, the blade and tip squealer configuration is altered to reduce stress, or blade tip coating is used. If a micro-crack in the static part will propagate, then the configuration of the hooks, scallops and the part thickness is reconfigured to reduce stress. Then, a #D analysis is performed for out-of-roundness, centerline bending and rotor sag. The design configuration and manufacturing is reiterated in order to optimize out-of-roundness.

15 Claims, 3 Drawing Sheets

OPTIMIZED BLADE TIP CLEARANCE PROCESS FOR A RUB TOLERANT DESIGN

CROSS REFERENCE TO RELATED APPLICATIONS

This application claims the benefit to an earlier filed U.S. Provisional application 60/763,090 filed on Jan. 27, 2006 and entitled OPTIMIZED BLADE TIP CLEARANCE PROCESS FOR A RUB TOLERANT DESIGN.

BACKGROUND OF THE INVENTION

1. Field of the Invention

The present invention relates to a gas turbine engine, and specifically to a process for determining an optimum rub of the blades in the compressor or turbine.

2. Description of the Related Art including information disclosed under 37 CFR 1.97 and 1.98

In gas turbine engines, the gap between the rotating blades in both the turbine and the compressor is a critical design parameter. It is desirable for an efficiency standpoint to reduce the gap between the rotating blade and the adjacent static part in order to reduce leakage of the gas stream across this gap. The leakage not only reduces efficiency of the compressor or the turbine, but also reduces the life of the blade tips and shroud members because of high temperatures acting on the parts.

Some gas turbine engine designers will set the gap such that the blades will not rub at all. Some designers provide a negative gap in order to produce rub during the initial engine break-in in order to allow for the normal wear from the rub to produce a smooth and close to zero gap as possible. However, this rub is a complicated process, and several factors can effect how the rub should be performed to produce the best results. Certain materials used by the blade tips and the shroud members that will rub can have undesirable results if the rub produces too much heat. Galling can occur. Many factors must be evaluated in the operation of the gas turbine engine, such as thermal growths, rotational imbalances, centrifugal forces due to rotations, tolerances in the machining, gravitation effects on the casing, and even the uneven heating and cooling of parts of the engine. All these factors can have an effect on the rub produced under engine break-in procedures.

With conventional metals against metals, very high temperatures can be generated quickly and can cause severe damage to the metal components. When metal galling occurs, the damage can be even more extensive. Galling occurs when metals with dissimilar hardness (the blade tip and the shroud metal) come in contact at high speeds and pressures. Galling begins at metal defects such as notches or scratches and eventually develops into hard protrusions on the metal surface. These protrusions gouge the metal material. Factors that effect galling are relative speed between metals in contact, pressure between the metals, and lubrication between the metal contact surfaces.

It is therefore an object of the present invention to provide an improved process for optimizing a blade tip clearance in a gas turbine engine.

SUMMARY OF THE INVENTION

The present invention describes a process for optimizing the blade tip clearance for a rub tolerate design in a gas turbine engine, and involves four major steps. In the first step, the process will first evaluate six candidate materials for their galling capability and heat generation on a rub rig. The second step is to analyze the engine transient tip clearance including restart after deceleration and resulting steady state clearance for three of the materials chosen from the six in the first step. The third step is to verify the optimum materials, cooling and heat shielding for the tip clearance and structures. The fourth step is to analyze and select the engine break-in procedure for optimum tip clearance between turbine and compressor. During these four steps, the material selection for the tip, the static part, and the break-in procedure is reiterated to determine is another material will produce more desirable results. Throughout the procedure, reiteration of materials is done and the analysis is done again with the new material until a desired result for rub is obtained. Then, a finite element method is used for both moving and static parts to determine if stresses will produce cracks. When all this is done, the process will perform a 3D analysis for out-of-roundness, centerline bending, and rotor sag, and reiterate the process to produce a better result, before the actual engine test with tip clearance measurements is performed.

DETAILED DESCRIPTION OF THE INVENTION

Figure 1:
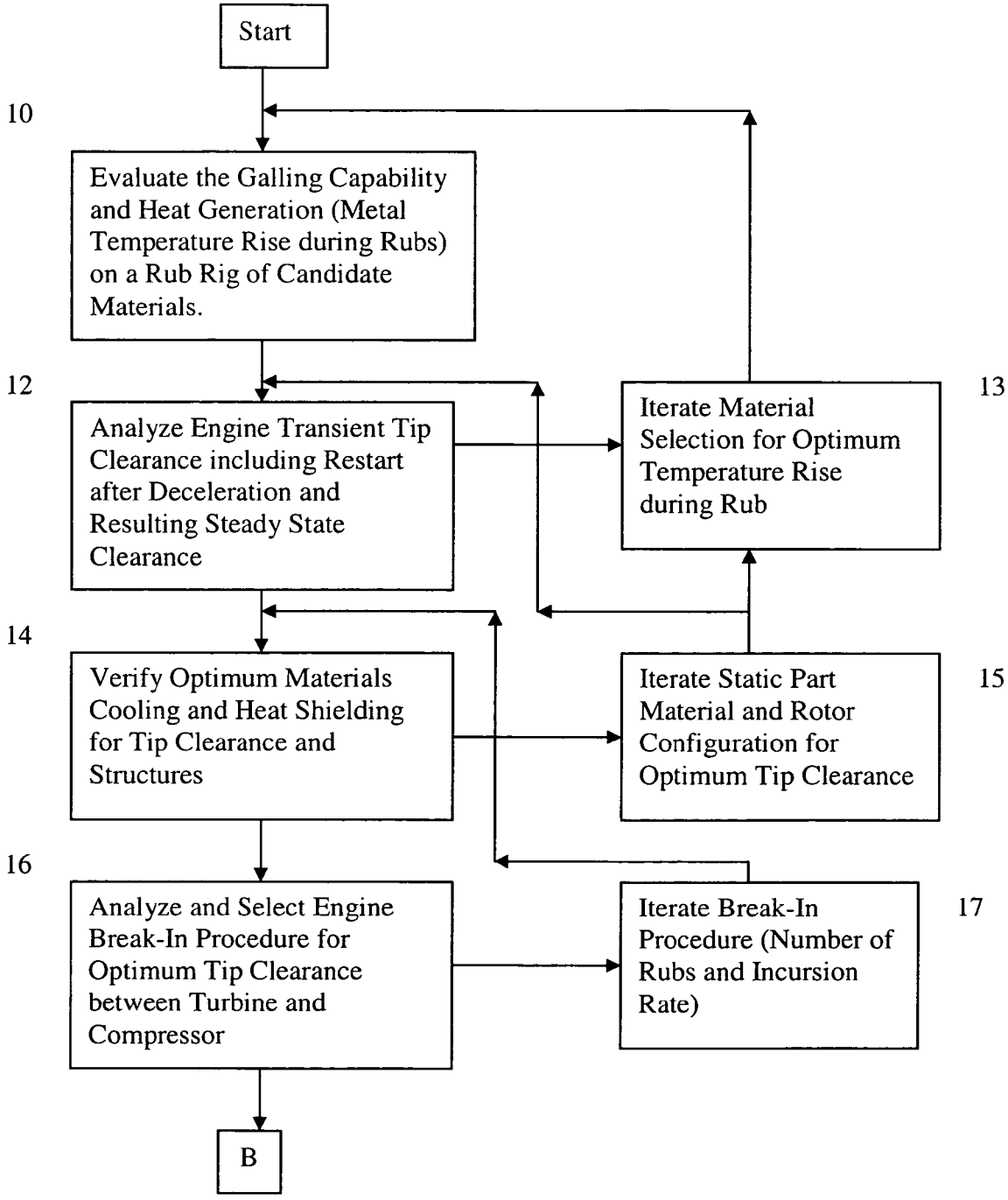
FIG. 1 shows the material selections process for the invention.

The present invention is a process to determine an optimum blade tip clearance in which the blades rub against the shroud member to produce a minimum gap. The process is represented by the flow chart shown in FIGS. 1 through 3. The process starts in FIG. 1 at step 10 in which six candidate materials are chosen and evaluated for material properties (such as galling resistance) and heat generation (metal temperature rise during rubs) on a rub rig. In this step, the candidate materials are evaluated to determine properties like the speed of rub at which the material will produce a snow-plowing effect in that the material builds up to form a large piece of material on the moving member, or at what speed the rub produces grooves like in a vinyl record. Each of these results—snow plowing or record grooves—is undesirable in the final rub process because they do not produce a smooth finish between the two materials that are rubbing. Each candidate material will produce these undesirable results at certain speeds. It is the purpose of this Evaluation step to determine the speed range for each material that will not produce these undesirable effects. In other embodiments, more or less than six candidate materials can be selected if warranted.

Step 12 is to analyze the engine transient tip clearance including restart after deceleration and resulting steady state clearance for each of three materials chosen from the list of six selected in step 10. In step 12, the engine operation is analyzed to determine what the blade clearance will be based upon the rotary forces acting on the blades and the thermal growth of the blades, shrouds, and other parts of the turbine that will effect the gap length such as the blade support ring, the rotor disc, and the engine casing. Three of the candidate materials are chosen in step 12, and each material is evaluated to determine what rub will exist and what resulting gap would result. Only three materials from the six materials in step 10 are chosen in step 12 because of the long time period of analysis needed to produce results from the analysis in step 12. Each of the parts of the engine involved in the rub or the gap produced between the blade tip and the outer shroud could be made from distinct materials. The analysis will be based on the various parts and the respective materials chosen.

If the analysis of step 12 determines that one or more of the three materials used in the analysis produces unacceptable results, then another material will be chosen. In step 13, the process will then iterate the material selection for optimum temperature rise during rub. One or more of the three materials used in the analysis of step 12 may be replaced with one or more of the original candidate materials chosen in step 10. A new analysis in step 12 is run with the new material or materials. If the analysis produces desired results, then the process moves on the step 14. If the results are not acceptable, then another material from the original six candidates is analyzed in step 12.

In step 14, the process will verify the optimum material cooling and heat shielding for tip clearance and structures. In this step, factors other than materials are analyzed to determine the gap and the rubbing that would result. Factors such as using a heat shield around the shroud, using a cooling fluid, or other structure that can affect the gap are analyzed. Using a heat shield may require use of a different material. Thus, the process may need to revert back to step 12 for an additional analysis of a certain material used under the environment of a heat shield to determine if the use of a heat shield with a certain material will produce a better result than not using a heat shield. The same reanalysis would be done for the process of using a cooling fluid or any other change to the engine.

In step 15, the process will iterate static part material and rotor configuration for optimum tip clearance, and choose a different material for reanalysis under different conditions of engine operation (e.g., heat shield, cooling fluid).

When the best materials have been chosen and the best structure (heat shield, cooling fluid arrangement, etc.) have been determined, the process goes to step 16 where the process will analyze and select engine break-in procedure for optimum tip clearance between the turbine and the compressor. The break-in process can be re-evaluated by running the break-in analysis under different material and structural conditions by the use of step 17 where the process will iterate the break-in procedure (number of rubs and incursion rate) based upon the different materials and the different engine operating structures such as whether heat shielding exists and if and how much cooling is used.

When steps 10, 12, 14, and 16 in the process have been completed and the most suitable materials and operating conditions have been selected, the process moves on to the steps in which the materials are evaluated for damage.

Figure 2:
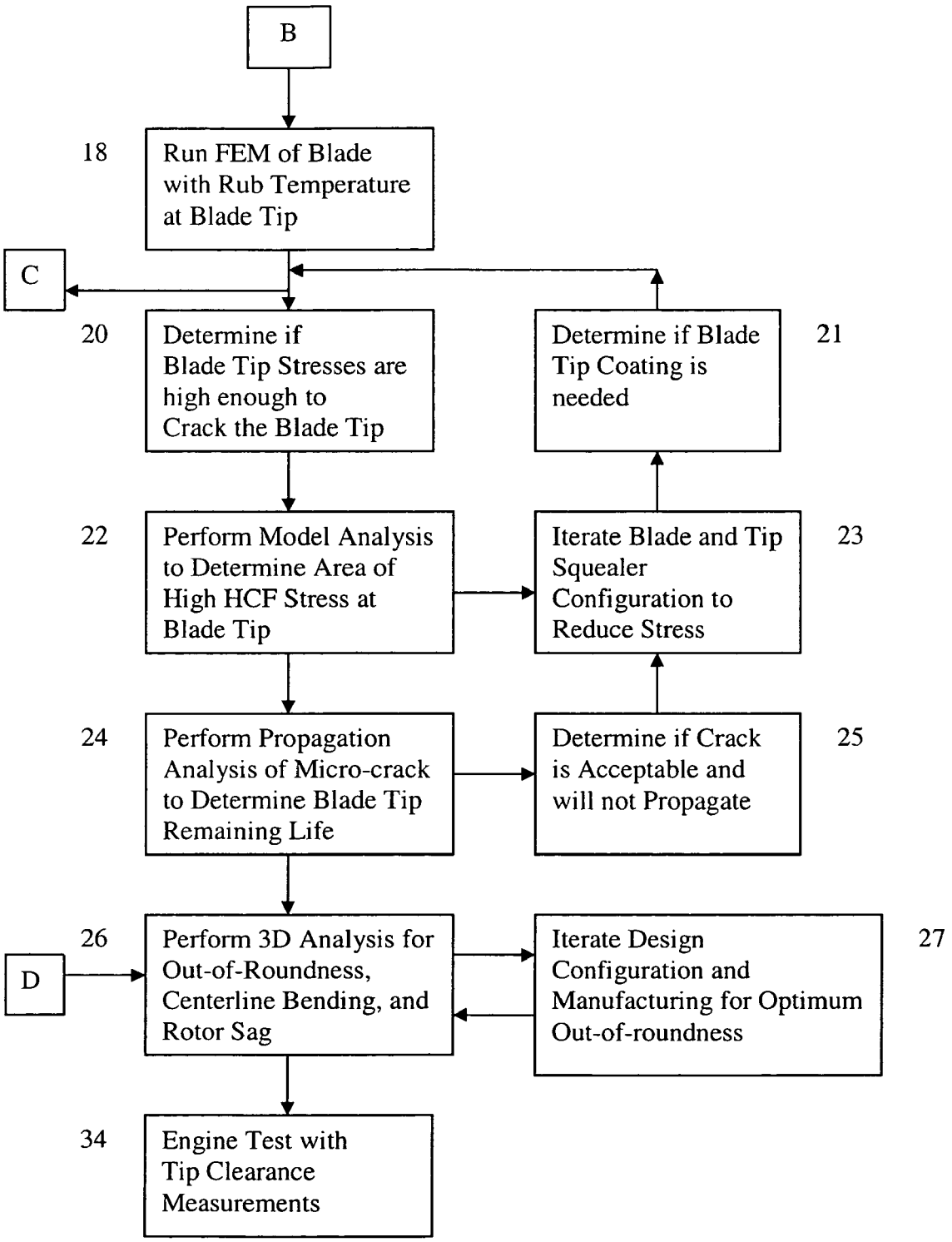
FIG. 2 shows the computer modeling process for the rotary blades of the invention.

Step 18 in FIG. 2 is to run finite element methods (FEM) of the blade with rub temperature at the blade tip. Step 20 is to determine if the blade tip stresses are high enough to crack the blade tip. Step 22 is to perform a model analysis to determine area of high HCF stress at the blade tip. Step 23 is to iterate the blade and tip squealer configuration to reduce stress. Step 21 is to determine if a blade tip coating is needed. Step 24 is to perform propagation analysis of micro-crack to determine the blade tip remaining life. Step 25 is to determine if the crack is acceptable and will not propagate.

Figure 3:
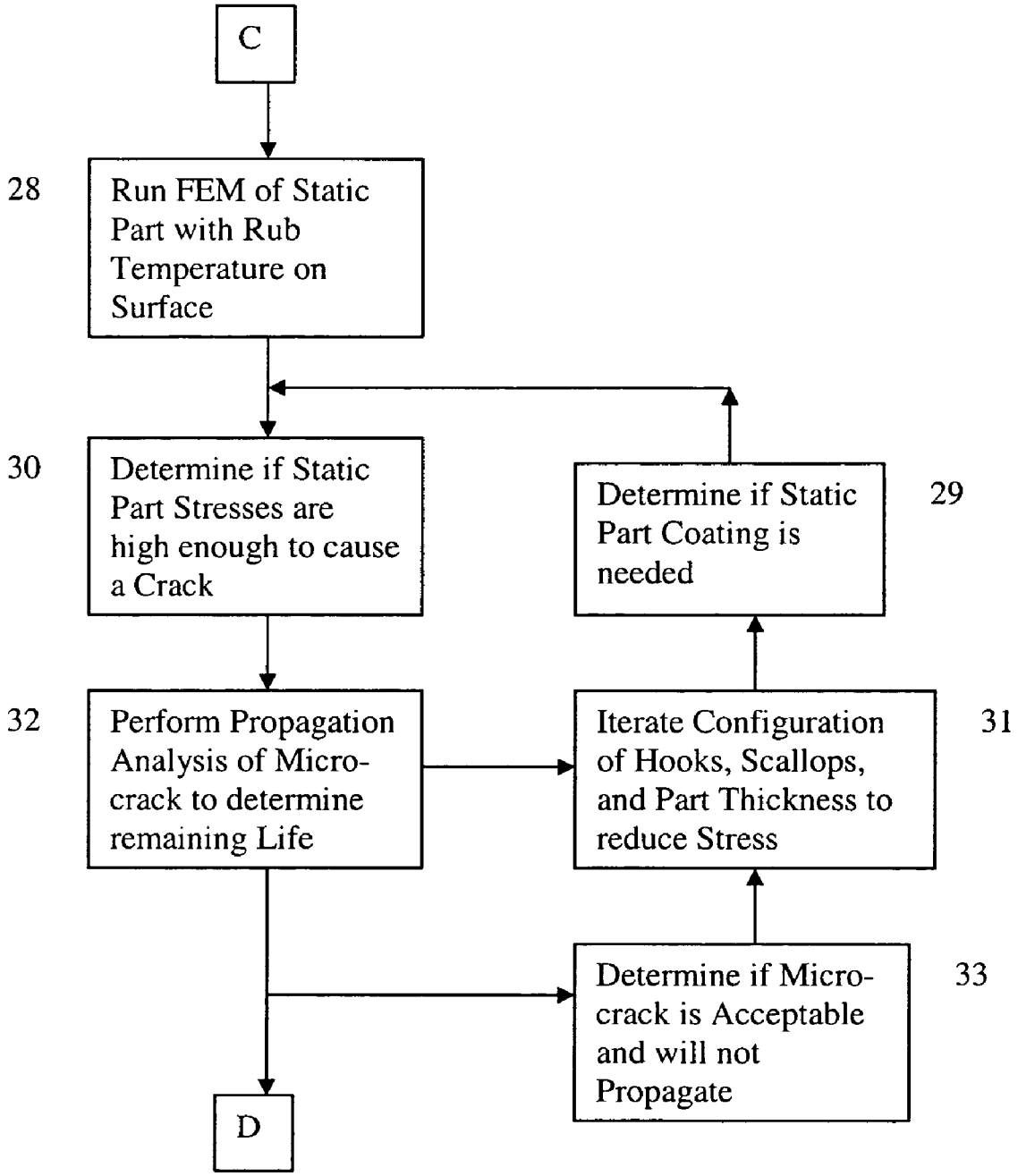
FIG. 3 shows the computer modeling process for the stationary parts of the invention.

While steps 18, 20, 22, and 24 are being processed, steps 28, 30, and 32 in FIG. 3 are also being done. Step 28 is to run FEM of the static part with the rub temperature on the surface. Step 28 is similar to step 18 in FIG. 2 but for a static part.

Step 30 is to determine if static part stresses are high enough to cause a crack. Step 32 is to perform propagation analysis of the micro-crack to determine the remaining life. Step 33 is to determine if micro-crack is acceptable and will not propagate. Step 31 is to iterate the configuration of hooks, scallops, and part thickness to reduce stress. Step 29 is to determine if static part cooling is needed.

When steps 28, 30 and 32 are optimized, the process continues to step 26 in FIG. 2 in which a 3D analysis is performed for out-of-roundness, centerline bending, and rotor sag of the engine.

Step 27 is to iterate the design configuration and manufacturing for optimum out-of-roundness. Step 34 is the actual engine test with tip clearance measurements.

We claim the following:

1. A process for optimizing a blade tip clearance in a gas turbine engine comprising the steps of:

Evaluate a plurality of candidate materials for galling;

Analyze engine transient tip clearance for a subset of the plurality of candidate materials;

Verify the optimum material cooling and heat shielding for tip clearance and structures for each of the subset materials; and, Analyze and select the engine break-in procedure for optimum tip clearance.

2. The process for optimizing a blade tip clearance of claim 1, and further comprising the step of:

The step of evaluating a plurality of candidate materials for galling includes the step of evaluating the candidate materials for heat generation.

3. The process for optimizing a blade tip clearance of claim 1, and further comprising the steps of:

The step of analyzing the subset of candidate materials includes the step of replacing a subset material that produces unacceptable results from the analysis with one of the candidate materials not original chosen for the subset materials; and, Analyze engine transient tip clearance for the new subset material.

4. The process for optimizing a blade tip clearance of claim 1, and further comprising the step of:

If the step of verifying the optimum material cooling and heat shielding for tip clearance and structures requires a heat shield be used in the engine, then perform an additional analysis of a certain material to determine if the use of a heat shield with a certain material will produce a better result than not using a heat shield.

5. The process for optimizing a blade tip clearance of claim 1, and further comprising the step of:

The step of analyzing and selecting the engine break-in procedure for optimum tip clearance includes running the break-in analysis using a different material and different engine operating structure to optimize the blade tip clearance.

6. The process for optimizing a blade tip clearance of claim 1, and further comprising the step of:

When the most suitable materials and operating conditions have been selected, run a finite element method analysis of the blade and the static parts to evaluate the materials for damage.

7. The process for optimizing a blade tip clearance of claim 6, and further comprising the step of:

The step of analyzing of the blade and the static parts to evaluate the materials for damage includes determining if the blade tip stresses are high enough to crack the blade tip.

8. The process for optimizing a blade tip clearance of claim 7, and further comprising the step of:

Perform a modal analysis to determine area of high HCF stress at the blade tip.

9. The process for optimizing a blade tip clearance of claim 8, and further comprising the step of:

Perform a propagation analysis of the micro-crack to determine blade tip remaining life.

10. The process for optimizing a blade tip clearance of claim 7, and further comprising the step of:

Perform a 3D analysis for out-of-roundness, centerline bending and rotor sag.

11. The process for optimizing a blade tip clearance of claim 10, and further comprising the step of:

Iterate design configuration and manufacturing for optimum out-of-roundness.

12. The process for optimizing a blade tip clearance of claim 11, and further comprising the step of:

Perform an engine test with tip clearance measurements.

13. The process for optimizing a blade tip clearance of claim 6, and further comprising the step of:

The step of running a finite element method analysis of the blade and the static parts to evaluate the materials for damage includes determining if the static part stresses are high enough to cause a crack.

14. The process for optimizing a blade tip clearance of claim 13, and further comprising the step of:

Performing propagation analysis of the micro-crack to determine a remaining life.

15. The process for optimizing a blade tip clearance of claim 14, and further comprising the step of:

If the micro-crack is not acceptable and will propagate, then iterate the configuration of the hooks, scallops and the part thickness to reduce stress.

* * * * *